US010562653B2

(12) United States Patent
Wikkerink et al.

(10) Patent No.: US 10,562,653 B2
(45) Date of Patent: Feb. 18, 2020

(54) EGG SORTING AND PACKAGING METHOD AND ASSEMBLY

(71) Applicant: SANOVO TECHNOLOGY NETHERLANDS B.V., Aalten (NL)

(72) Inventors: Dirk Willem Wikkerink, Aalten (NL); Jan Hordijk, Aalten (NL)

(73) Assignee: SANOVO TECHNOLOGY NETHERLANDS B.V., Aalten (NL)

( * ) Notice: Subject to any disclaimer, the term of this patent is extended or adjusted under 35 U.S.C. 154(b) by 54 days.

(21) Appl. No.: 15/565,588

(22) PCT Filed: Mar. 30, 2016

(86) PCT No.: PCT/NL2016/050219
§ 371 (c)(1),
(2) Date: Oct. 10, 2017

(87) PCT Pub. No.: WO2016/171547
PCT Pub. Date: Oct. 27, 2016

(65) Prior Publication Data

US 2018/0105299 A1 Apr. 19, 2018

(30) Foreign Application Priority Data

Apr. 22, 2015 (NL) ..... 2014692

(51) Int. Cl.

| | |
|---|---|
| ***B65B 23/06*** | (2006.01) |
| ***B65B 35/24*** | (2006.01) |
| ***B65B 57/00*** | (2006.01) |
| ***B65B 57/06*** | (2006.01) |

(52) U.S. Cl.
CPC ..... *B65B 23/06* (2013.01); *B65B 35/24* (2013.01); *B65B 57/00* (2013.01); *B65B 57/06* (2013.01)

(58) Field of Classification Search
CPC ..... B65G 23/06; B65B 57/06
USPC ..... 198/445
See application file for complete search history.

(56) References Cited

U.S. PATENT DOCUMENTS 6,513,641 B1 * 2/2003 Affaticati ..... B07C 5/36 198/357

FOREIGN PATENT DOCUMENTS

EP 1 201 542 A1 5/2002
JP 2004284598 A * 10/2004

OTHER PUBLICATIONS

International Search Report for PCT/NL2016/050219 dated Jul. 13, 2016.

(Continued)

*Primary Examiner* — Timothy R Waggoner
*Assistant Examiner* — Lester Rushin, III
(74) *Attorney, Agent, or Firm* — Nixon Peabody LLP; Jeffrey L. Costellia

(57) ABSTRACT

An egg sorting and packaging method and assembly, wherein eggs are placed on an endless egg conveyor (2) by means of an egg supply device (3). The eggs are selectively moved from the endless egg conveyor into packaging lines (6*a*-6*c*), in which packaging lines the eggs are packed into egg packages. Eggs which are not released into one of the packaging lines remain on the endless egg conveyor and are recycled to pass by the packaging lines again in order to be released into one of the packaging lines.

9 Claims, 5 Drawing Sheets

(56) References Cited

OTHER PUBLICATIONS

Written Opinion for PCT/NL2016/050219 dated Jul. 13, 2016.
Netherlands Search Report for PCT/NL2016/050219 dated Nov. 7, 2015.
Netherlands Written Opinion for PCT/NL2016/050219 dated Nov. 7, 2015.

* cited by examiner

EGG SORTING AND PACKAGING METHOD AND ASSEMBLY

FIELD OF THE INVENTION

The present invention relates to an egg sorting and packaging method and assembly.

In particular the invention relates to an egg sorting and packaging method and assembly, wherein eggs are placed on an endless egg conveyor by means of an egg supply device and the eggs are selectively moved from the endless egg conveyor into packaging lines, in which packaging lines the eggs are packed into egg packages.

BACKGROUND OF THE INVENTION

In general eggs can be divided into more valuable eggs and less valuable eggs. The more valuable eggs are often the eggs meant for consumers. They can be graded into different size, weight or quality classes. They are mainly packed into egg boxes or egg trays. Eggs that are mainly meant for the food industry and are processed into other products may be eggs which are rejected because of cracks, dirt on the shell, or containing blood. Such eggs are economically less valuable.

In an egg packaging process it may occur that eggs cannot be moved into a packaging line, e.g. because there is no package available into which an egg can be placed, because there is a full package which is not removed, or because of some kind of technical failure.

Stopping the sorting and packaging assembly to resolve the issue when eggs cannot be packed is an option, but because a whole processing line has to be stopped it is economically very unfavourable. Therefore it is hitherto common to release all eggs from the endless egg conveyor downstream of the last packaging line. Mostly an endless egg conveyor has controllable retainers, which are all automatically opened after the last packaging line has been passed. In this way it is ensured that the endless egg conveyor is empty when the egg retainers pass the supply device to receive new eggs. The eggs that are removed are handled as eggs which are used in industry. Often they are broken when released from the endless conveyor.

A disadvantage of this known process is that eggs that as such are suitable to be sold as consumer eggs end up being treated as eggs to be processed in industry, which implicates an economic loss.

The present invention has for an object to provide egg sorting and packaging method and/or assembly by which the economic profit of a batch of eggs is increased.

SUMMARY OF THE INVENTION

This object is achieved by an egg sorting and packaging method, wherein

- eggs are placed on an endless egg conveyor by means of an egg supply device;
- the eggs are selectively moved from the endless egg conveyor into packaging lines, in which packaging lines the eggs are packed into egg packages; and wherein eggs which are not released into one of the packaging lines remain on the endless egg conveyor and are recycled to pass by the packaging lines again in order to be released into one of the packaging lines.

By recycling the eggs a higher percentage of the more valuable eggs can be packed in the packaging lines.

In one particular embodiment said recycling of the eggs comprises removing the eggs from the endless egg conveyor on a location upstream from the supply device onto a buffering bypass device, and replacing the eggs from the buffering bypass device on the endless egg conveyor on a location downstream of the supply device.

In another particular embodiment said recycling of eggs comprises leaving the eggs on the endless egg conveyor and moving the eggs on the endless egg conveyor past the supply device, wherein, preferably, the egg supply device removes eggs from the supply that would have to be placed on a position on the endless egg conveyor that is already occupied by a recycled egg and leads the removed egg back to an egg supply line.

In a further embodiment of the method according to the invention:

- eggs are graded and at least divided in first choice and second choice eggs;
- at least the eggs graded as first choice eggs are placed on the endless egg conveyor by means of the egg supply device;
- the eggs graded as second choice are removed at the egg supply device, or are placed on the endless egg conveyor and released from the endless egg conveyor to a handling line (e.g. a packaging line) for second choice eggs.

In practise about 5-10% of the graded eggs will be determined to be second choice eggs. These second choice eggs will in general be the eggs that are to be moved to industry to be processed there. The places on the endless egg conveyor made free by removing the second choice eggs is used to replace first choice eggs from the buffering bypass device. The first choice eggs will in general be the eggs for consumers. Thus eggs, that in first instance could not be moved into one of the packaging lines, are moved through a bypass means and recycled to the egg conveyor which conveys the eggs past the packaging lines again and these eggs can in second instance be moved into the designated packaging line.

Alternatively, the second choice eggs are removed before they are supplied to the endless egg conveyor. The empty spots in the supply may coincide with recycled eggs on the endless egg conveyor (in 5-10% this will be the case), whereby less first choice eggs have to be removed at the supply device.

The invention also relates to an egg sorting and packaging assembly comprising:

- an endless egg conveyor;
- an egg supply device for supplying and moving eggs onto the endless egg conveyor;
- one or more packaging lines associated with the endless egg conveyor configured and arranged to receive eggs from the endless egg conveyor;
- a buffering bypass device associated with the endless egg conveyor configured and arranged to remove eggs from the endless egg conveyor downstream of the packaging lines and to replace the eggs on the endless egg conveyor upstream of the packaging lines.

In a possible embodiment the sorting and packaging assembly furthermore comprises an egg grading assembly for grading eggs in at least first choice and second choice, wherein the one or more packaging lines associated with the endless egg conveyor are configured and arranged to selectively receive eggs graded as first choice from the endless egg conveyor.

In a possible further embodiment the egg grading assembly is adapted and arranged to remove eggs graded as second choice.

In an alternative further embodiment the assembly comprises a handling line for second choice graded eggs which is associated with the endless egg conveyor downstream of the egg supply device and configured and arranged to selectively receive eggs graded as second choice from the endless conveyor, wherein the buffering bypass device replaces the first choice eggs between the handling line and the packaging lines. The second choice eggs are first removed from the endless egg conveyor and moved into the associated second choice egg handling lane, which could be a packaging line for second choice eggs. This provides the empty places on the endless egg conveyor for first choice eggs to be recycled onto the endless egg conveyor. It reduces the amount of first choice eggs that are handled as second choice eggs which provides an economical advantage.

In a possible embodiment of the assembly the endless egg conveyor includes at least one endless element running around a set of rotational wheels rotating around respective rotational axes and a drive unit defining a conveying direction of the conveyor, said egg conveyor having an upper run and a lower run and head sections where the direction of movement of the endless element between the upper run and the lower run is reversed over one or more of said rotational wheels, wherein the egg conveyor furthermore includes at least one lane of egg retainers coupled to the endless element, said lane of retainers in use moving in the conveying direction, each of said retainers being adapted to receive an egg from an upper side and to release an egg from an underside thereof.

Preferably the egg supply device is configured and arranged such that it supplies eggs to the upper run of the endless egg conveyor.

Preferably the packaging lines associated with the endless egg conveyor are configured and arranged to receive eggs from the lower run of the endless egg conveyor.

In a possible embodiment the buffering bypass device comprises a buffering conveyor having egg retainers and being arranged between the upper run and lower run of the endless egg conveyor, said buffering conveyor being configured and arranged to receive eggs from egg retainers from the upper run and forward and release said eggs to egg retainers on the lower run.

The buffering conveyor may be and endless conveyor, e.g. comprising an endless chain or belt wherein the retainers are coupled to the endless chain or belt.

In a possible embodiment the assembly comprises a control unit which is connected to the endless egg conveyor and the buffering bypass device, said control unit being adapted to keep track of the location of eggs in the endless egg conveyor, and being programmed to control the buffering bypass device such that eggs are released from the buffering bypass device retainers into egg retainers of the endless egg conveyor which are emptied at the handling line for second choice eggs.

The invention also relates to an egg sorting and packaging assembly comprising:

- an endless egg conveyor;
- an egg supply device for supplying and moving eggs onto the endless egg conveyor;
- one or more packaging lines associated with the endless egg conveyor, said one or more packaging lines being configured and arranged to receive eggs from the endless egg conveyor;
- wherein the egg supply device is adapted and arranged to remove eggs that would have to be placed on a position on the endless egg conveyor that is already occupied by an egg that could not be received in a packaging line, and leads the removed egg back to an egg supply line.

In a practical embodiment the egg sorting and packaging assembly furthermore comprises a control unit which keeps track of the eggs on the endless egg conveyor as well as of eggs that are placed by the egg supply device on the endless egg conveyor, wherein the control unit is operatively connected to the egg supply device to control the movement of eggs onto the endless conveyor and the removal of eggs that cannot be moved onto the endless egg conveyor.

In a possible embodiment of this assembly the endless egg conveyor includes at least one endless element running around a set of rotational wheels rotating around respective rotational axes and a drive unit defining a conveying direction of the conveyor, said egg conveyor having an upper run and a lower run and head sections where the direction of movement of the endless element between the upper run and the lower run is reversed over one or more of said rotational wheels, wherein the egg conveyor furthermore includes at least one lane of egg retainers coupled to the endless element, said lane of retainers in use moving in the conveying direction.

Possibly, each of said retainers may be adapted to receive an egg from an upper side and to release an egg from an underside thereof. In this configuration the egg supply device may configured and arranged such that it supplies eggs to the upper run of the endless egg conveyor and the packaging lines associated with the endless egg conveyor may be configured and arranged to receive eggs from the lower run of the endless egg conveyor.

The invention will be elucidated in the following description with reference to the drawing.

DETAILED DESCRIPTION OF THE PREFERRED EMBODIMENTS

Figure 1:
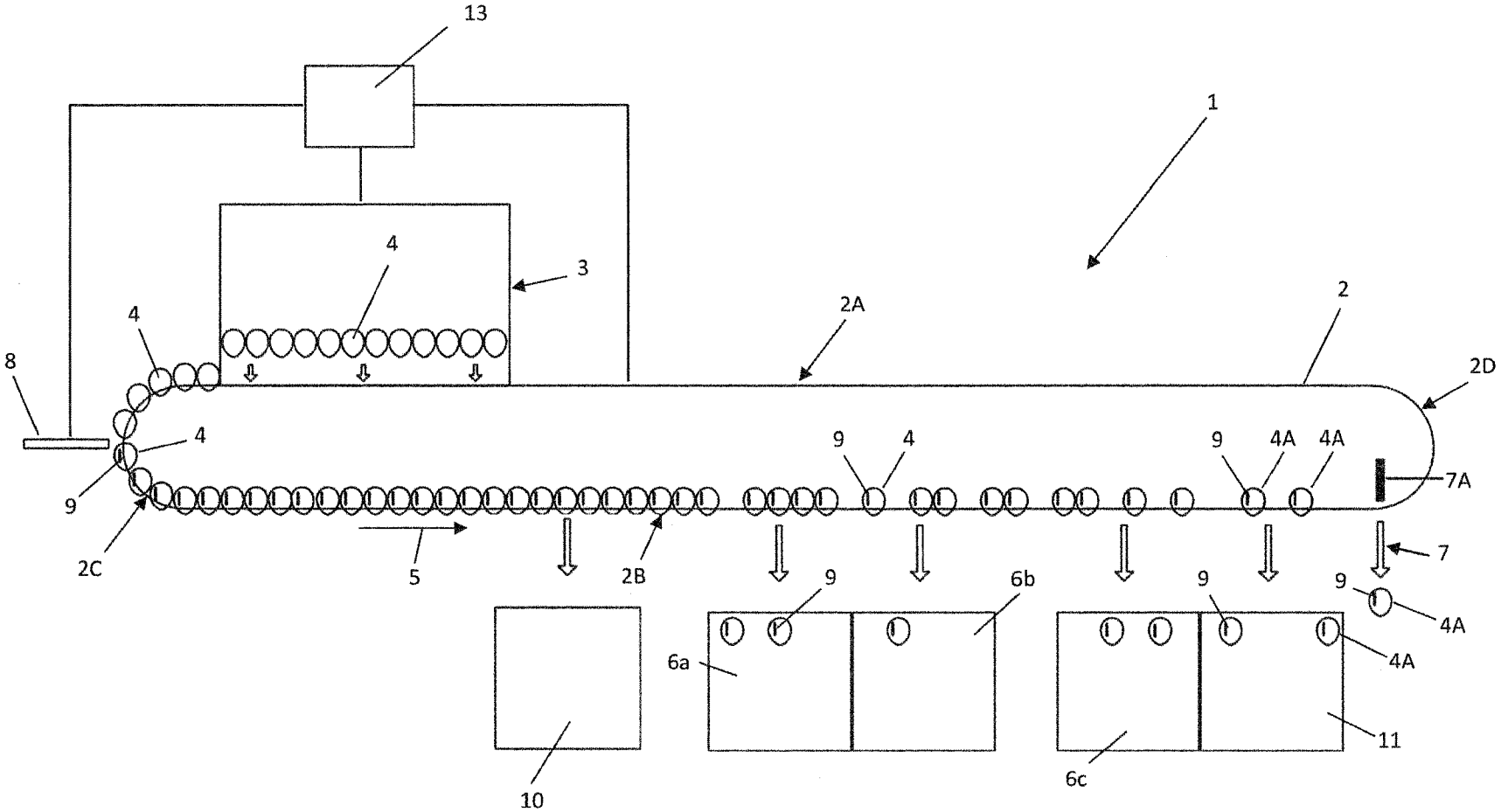
FIG. 1 shows schematically an egg sorting and packaging assembly according to the prior art.

FIG. 1 shows an egg sorting and packaging assembly 1 comprising an endless egg conveyor 2. The endless egg conveyor 2 has a conveying direction indicated by arrow 5.

Typically the endless egg conveyor 2 includes at least one chain or another endless element running around a set of sprockets or another type of rotational wheel. The chain is driven by a drive unit which defines a conveying direction 5 of the conveyor 2. The egg conveyor 2 typically has an upper run 2A and a lower run 2B and head sections 2C and 2D where the direction of movement of the endless element between the upper run 2A and the lower run 2B is reversed over one or more of said rotational wheels. The egg conveyor 2 furthermore includes at least one lane, but in practise usually a plurality of lanes, such as four or six, of egg retainers coupled to the endless element. The lane of retainers in use moving in the conveying direction 5. In a practical embodiment the egg retainers are formed as pockets adapted to receive an egg 4 from an upper side and to release an egg 4 from an underside thereof, which is not shown in detail here.

The assembly 1 furthermore comprises an egg supply device 3 for supplying and moving eggs 4 onto the endless egg conveyor 2. The egg supply device 3 supplies the eggs on the upper run 2A of the conveyor 2 and thus puts the eggs 4 from above in the pockets.

The eggs are graded/sorted before they are fed by the supply device 3 to the endless conveyor 2.

The assembly 1 also comprises packaging lines 6*a*-6*c* associated with the endless egg conveyor 2 downstream which packaging lines 6*a*-6*c* are configured and arranged to selectively receive eggs 4 graded as first choice from the endless egg conveyor 2. In the packaging lines 6*a*-6*c* eggs 4 are placed into egg cartons, egg trays or other suitable egg packages.

A control unit 13 is present which is operatively connected to the supply device 3 and the conveyor 2. The control unit 13 controls the release of eggs 4 into the respective lanes 10, 6*a*-6*c* and 11.

In a practical embodiment the egg receiving portion of the respective packaging lines 6*a*-6*c* is located below the lower run 2B of the endless egg conveyor 2. The eggs 4 can conveniently be released from the underside of the pockets of the egg conveyor 2 and placed into one of the packaging lines 6*a*-6*c*.

First choice eggs are eggs meant for consumer use for example sold in retail etc. Eggs can also be graded as second choice. This means these eggs are not suitable to be sold as a consumption product, but they are sold at a lower price than first choice eggs to the food industry where they are broken and processed into other products. Second choice eggs may be eggs having a cracked shell, dirt on the shell or eggs containing blood.

In the egg sorting assembly 1 shown in FIG. 1 only the eggs graded as first choice are moved into the respective packaging lines 6*a*-6*c*. A handling line 10 for second choice graded eggs is present. This handling line 10 is located at the endless egg conveyor 2 downstream of the egg supply device 3 and upstream of the packaging lines 6*a*-6*c*. In the handling line 10 eggs are selectively received that are graded as second choice from the endless conveyor 2.

The assembly has an overflow line 11, which is downstream of the other packaging lines 6*a*-6*c*. Eggs 4A that remain on the endless conveyor 2, may be released into this overflow line 11, where unsorted eggs are collected.

Finally the assembly 1 has an automatic discharge feature 7 including an unlocking pin 7A where eggs that could not be released into the handling line 10 or packaging lines 6*a*-6*c*, 11 are automatically discharged from the egg retainers such that is assured that all the egg retainers of the endless egg conveyor 2 are emptied. The eggs that are discharged at 7 are dropped in a collection container in which they mostly break.

It may occur that an interruption of normal operation in one of the egg packaging lines 6*a*-6*c* takes place, whereby first choice eggs cannot be moved into the packaging line 6*a*-6*c* concerned. Such an interruption may take place because there is for example no package present or there is a technical failure in the equipment.

In particular when the eggs 4 are printed whilst on the endless egg conveyor 2, it is not an option to remove the remaining eggs 4 and recycle them into the supply device 3, because the printed eggs would be graded/sorted again and then be printed again. However, an egg that is printed twice cannot be sold as a consumer egg. In FIG. 1 is shown a printer 8 at the head end 2C of the conveyor 2 which prints an indication on the egg 4 regarding date, grade, origin, etc. The printed indication is indicated by reference numeral 9. The printer is connected to the control unit 13. The control unit 13 is also connected to the supply unit 3 and/or to a grading assembly in order to record information on the grade of the egg, which is used in the printing of the indication 9 of the egg 4 concerned.

A practical option to deal with this is that the eggs, which are as such graded as first choice eggs are moved on by the endless egg conveyor 2 and then released into the overflow line 11 leading to a handling or packaging line for second choice eggs.

At the discharge feature 7 all the remaining eggs are released such that new eggs can always be placed by the supply device 3 into the pockets of the endless egg conveyor 2. An advantage of this method is that the operation of the assembly 1 does not have to be interrupted entirely at every occasion that a interruption takes place in one of the packaging lines 6*a*-6*c*, 10 and the overflow line 11. Thereby the handling capacity of the sorting assembly can remain high. However, it is an obvious disadvantage that perfectly good first choice eggs have to be treated as second choice eggs in the overflow line and the discharge feature 7, which leads to an economic loss.

Figure 2:
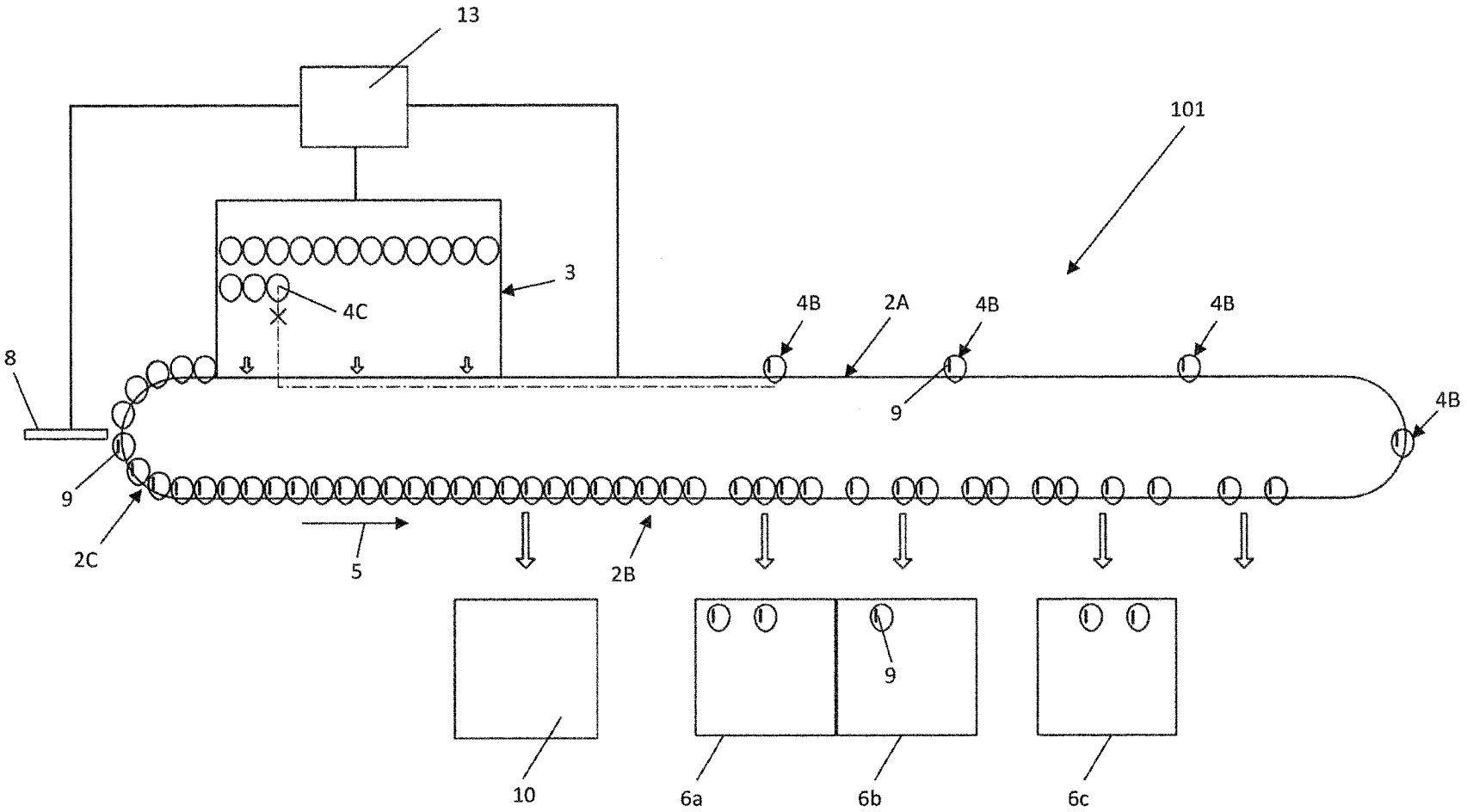
FIG. 2 shows schematically a possible embodiment of an egg sorting and packaging assembly according to the invention.

In FIG. 2 is shown schematically an egg sorting and packaging assembly 101 according to the invention which may be used to reduce the economic loss as mentioned above. The same parts are indicated by the same reference numerals and for a general description of the assembly is referred to the above.

In this sorting and packaging assembly 101 there is no overflow line and there is no discharge feature. In this assembly 101 the first choice eggs 4B that cannot be placed into one of the egg packaging lines 6*a*-6*c* are not removed but remain in the pockets of the endless conveyor 2. The assembly 101 comprises a control unit 13, which keeps track of the eggs on the endless egg conveyor 2 and eggs that are placed by the supply device 3 on the endless egg conveyor 2. The control unit 13 controls the supply device 3 and an egg 4C, that would have to be placed into a pocket in which is still an egg 4B, is removed at the supply device such that it is not put into an already filled pocket. The removed egg 4C can be recycled into a grading/sorting line and be fed to the supply device 3 again. This is in particular a practical solution if the eggs are printed whilst on the endless egg conveyor 2. The control unit 13 is also connected to the printer and knows on what positions on the conveyor 2 new non-printed eggs are placed by the supply device 3. Thus the control unit 13 can determine which egg has to be printed by the printer 8, and which not. A disadvantage is that eggs 4C removed at the supply device 3 have to be sorted/graded again and be fed again to the supply device 3.

Figure 2A:
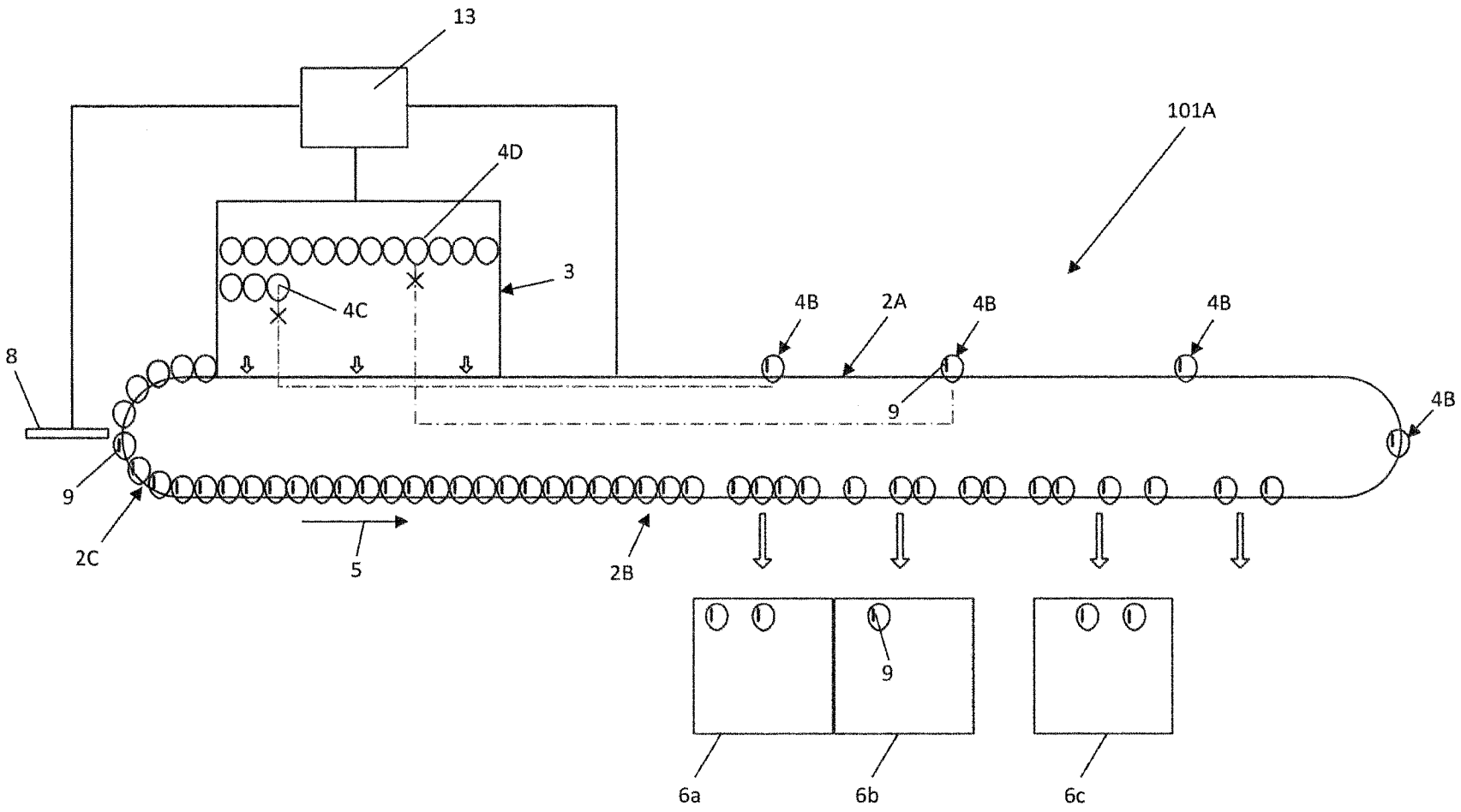
FIG. 2A shows schematically another possible embodiment of an egg sorting and packaging assembly according to the invention.

In FIG. 2A an alternative is shown of the assembly 101 of FIG. 2. In this assembly 101A not only an egg 4C that cannot be placed on the endless conveyor 2 due to a recycled egg 4B is removed, but also a second choice egg 4D is removed at the supply device 3. Where in FIG. 2 there is still a packaging line 10 for second choice eggs, such a packaging line 10 is omitted in the assembly of FIG. 2A and replaced by the feature that the supply device 3 already removes second choice eggs 4D.

Figure 3:
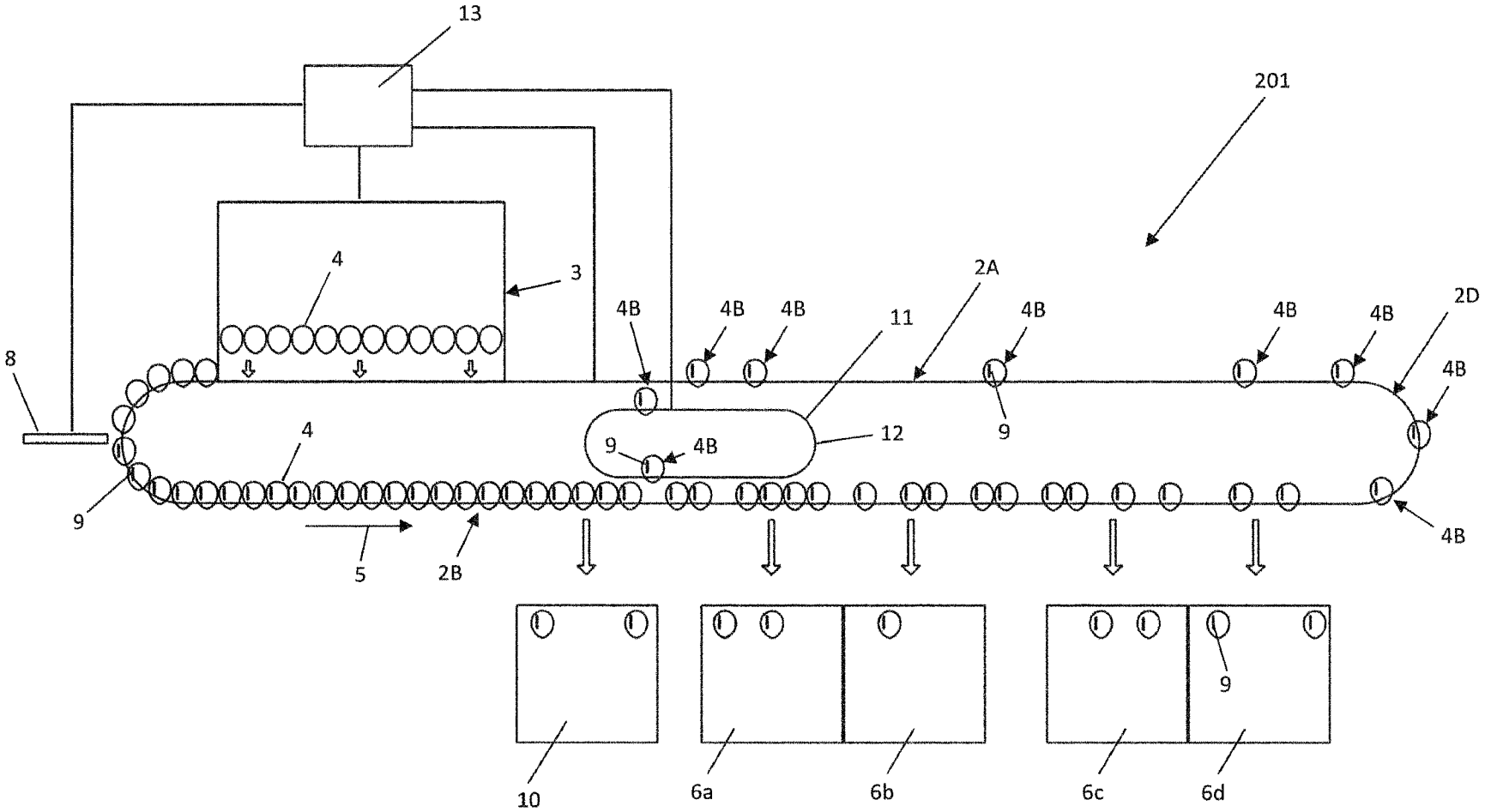
FIG. 3 shows schematically yet another possible embodiment of an egg sorting and packaging assembly according to the invention.

In FIG. 3 another egg sorting and packaging assembly 201 according to the invention is schematically shown. The same parts are indicated with the same reference numerals as in FIG. 1.

In this assembly 201 a handling line 10 for second choice graded eggs is present. This handling line 10 is located at the endless egg conveyor 2 downstream of the egg supply device 3 and the printer 8. This handling line 10 is located upstream of the packaging lines 6*a*-6*d*. In the handling line 10 eggs are selectively received that are graded as second choice from the endless conveyor 2.

The sorting and packaging assembly 201 furthermore comprises a buffering bypass device 11 associated with the endless egg conveyor 2. The buffering bypass device 11 is configured and arranged to remove eggs 4B from the endless egg conveyor 2 downstream of the packaging lines 6*a*-6*d* and to replace the eggs 4B on the endless egg conveyor 2 on a location between the handling line 10 and the packaging lines 6*a*-6*d*.

In particular the buffering bypass device 11 comprises a buffering conveyor 12 having egg retainers and being arranged between the upper run 2A and lower run 2B of the endless egg conveyor 2. The buffering conveyor 12 receives eggs 4 from egg retainers from the upper run 2A and forwards these eggs and releases said eggs to egg retainers on the lower run 2B.

The buffering conveyor 12 is illustrated in this embodiment as a circulating endless conveyor including an endless element such as a chain or a belt which is coupled to the egg retainers of the conveyor 12. This is a practical example of the buffering conveyor 12, but the buffering bypass device 11 may also include another conveying/transfer apparatus or assembly with a bypass and buffering function.

The second choice eggs are removed from the endless egg conveyor 2 and moved into the associated second choice egg handling lane 10. In practise about 5-10% of the graded eggs will be determined to be second choice and removed. The pockets on the endless conveyor 2 made free by removing the second choice eggs are used to replace first choice eggs from the buffering recycling device 11. Thus eggs 4 that in first instance could not be moved into one of the packaging lines 6*a*-6*d* are recycled via the buffering bypass device 11 onto the egg conveyor 2 which conveys the eggs 4 past the packaging lines 6*a*-6*d* again and the eggs 4B can in second instance be moved into the designated packaging line 6*a*-6*d*. This method reduces the amount of first choice eggs that are handled as second choice eggs which provides an economical advantage. Furthermore recycled eggs 4C in FIG. 2 do not have to be graded/sorted again as was the case in the assembly 101 shown in FIG. 2.

Figure 3A:
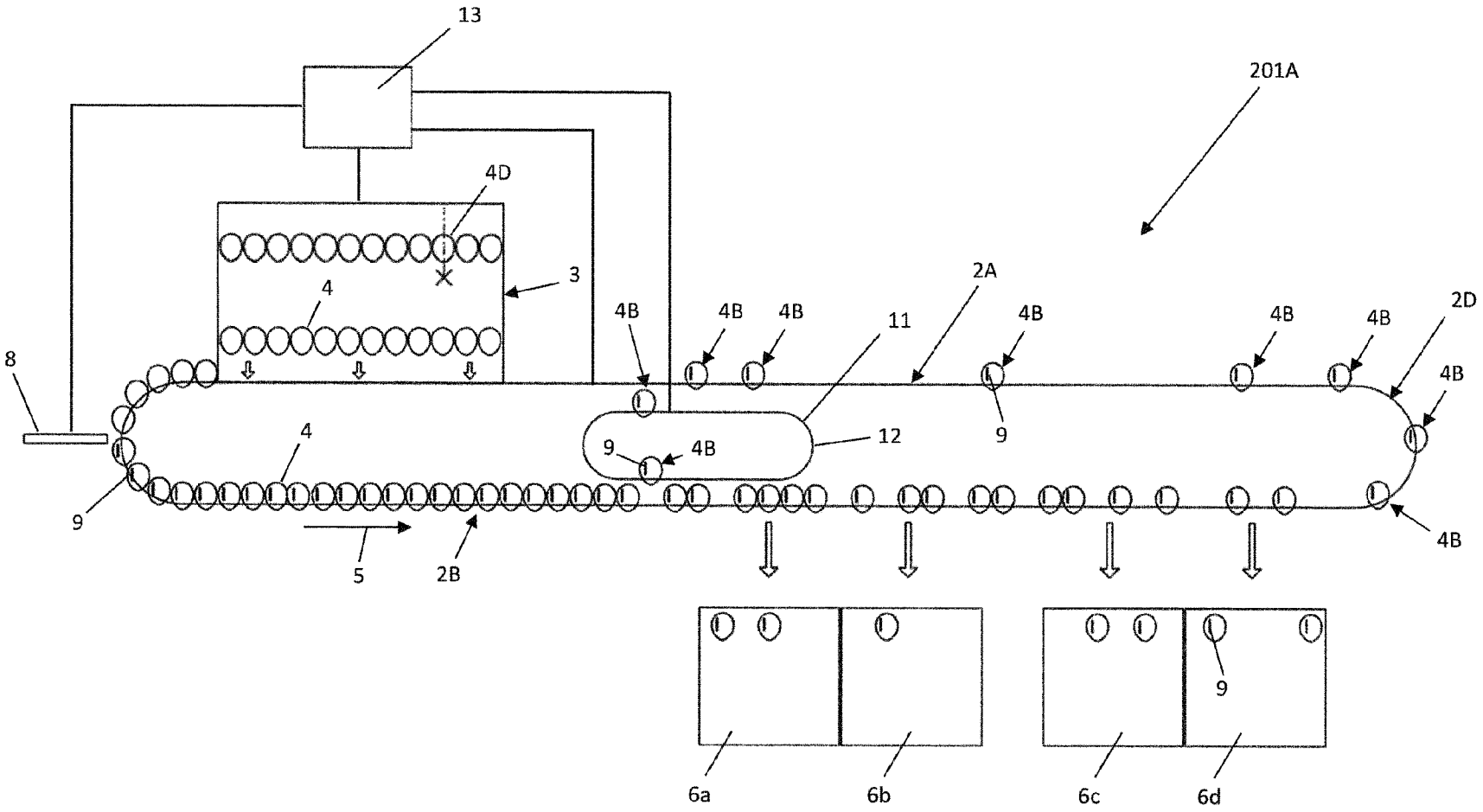
FIG. 3A shows schematically still another possible embodiment of an egg sorting and packaging assembly according to the invention.

In FIG. 3A an alternative assembly 201A of the assembly of FIG. 3 is shown. In this assembly 201A the handling line 10 for the second choice eggs is omitted and second choice eggs 4D are removed at the supply device 3 as was also the case in the embodiment of FIG. 2A. The removed eggs 4D are guided from the supply device 3 towards a different packaging line for example. Hence, also in this sorting and packaging assembly 201D second choice eggs will not arrive at the endless egg conveyor 2, whereby the risk of smearing and spoiling of the conveyor 2 is also reduced.

It is noted that in the above description the invention is described mainly in the context of the grading between first choice eggs and second choice eggs, wherein the first choice eggs are eggs that are suitable to be sold to consumers and second choice eggs are intended to be processed in the industry. However, it must be understood that the distinction does not necessarily have to be consumer eggs vs. industry eggs, but may also be between consumer eggs of different value, color, size, weight, etc. Important is to understand that the method and assemblies according to the invention may advantageously be used to give preferential treatment to the most desirable eggs (i.e. usually the most valuable eggs) under the given circumstances.

The invention claimed is:

1. An egg sorting and packaging assembly comprising:

an endless egg conveyor;

an egg supply device for supplying and moving eggs onto the endless egg conveyor;

one or more packaging lines associated with the endless egg conveyor configured and arranged to receive eggs from the endless egg conveyor and place the received eggs in egg packages;

a buffering bypass device associated with the endless egg conveyor configured and arranged to remove eggs from the endless egg conveyor downstream of the packaging lines and upstream of the egg supply device and to replace the buffered eggs on the endless egg conveyor downstream of the egg supply device and upstream of the packaging lines.

2. The egg sorting and packaging assembly according to claim 1, furthermore comprising an egg grading assembly for grading eggs in at least first choice and second choice, wherein the one or more packaging lines associated with the endless egg conveyor are configured and arranged to selectively receive eggs graded as first choice from the endless egg conveyor.

3. The egg sorting and packaging assembly according to claim 2, wherein the egg grading assembly is adapted and arranged to remove eggs graded as second choice.

4. The egg sorting and packaging assembly according to claim 2, furthermore comprising a handling line for second choice graded eggs which is associated with the endless egg conveyor downstream of the egg supply device and configured and arranged to selectively receive eggs graded as second choice from the endless conveyor, wherein the buffering bypass device replaces the first choice eggs between the handling line and the packaging lines.

5. The egg sorting and packaging assembly according to claim 1, wherein the endless egg conveyor includes at least one endless element running around a set of rotational wheels rotating around respective rotational axes and a drive unit defining a conveying direction of the conveyor, said egg conveyor having an upper run and a lower run and head sections where the direction of movement of the endless element between the upper run and the lower run is reversed over one or more of said rotational wheels, wherein the egg conveyor furthermore includes at least one lane of egg retainers coupled to the endless element, said lane of retainers in use moving in the conveying direction, each of said retainers being adapted to receive an egg from an upper side and to release an egg from an underside thereof.

6. The egg sorting and packaging assembly according to claim 5, wherein the egg supply device is configured and arranged such that it supplies eggs to the upper run of the endless egg conveyor.

7. The egg sorting and packaging assembly according to claim 5, wherein the packaging lines associated with the endless egg conveyor are configured and arranged to receive eggs from the lower run of the endless egg conveyor.

8. The egg sorting and packaging assembly according to claim 5, wherein the buffering bypass device comprises a buffering conveyor having egg retainers and being arranged between the upper run and lower run of the endless egg conveyor, said buffering conveyor being configured and arranged to receive eggs from egg retainers from the upper run and forward and release said eggs to egg retainers on the lower run.

9. The egg sorting and packaging assembly according to claim 8, wherein the assembly comprises a control unit which is connected to the endless egg conveyor and the buffering conveyor, said control unit being adapted to keep track of the location of eggs in the endless egg conveyor, and being programmed to control the buffering conveyor such that eggs are released from the buffering conveyor retainers into egg retainers of the endless egg conveyor which are emptied at the handling line for second choice eggs.

* * * * *